United States Patent [19]

Dussart

[11] 4,103,730

[45] Aug. 1, 1978

[54] PROCESS FOR ELECTROMAGNETIC STIRRING

[75] Inventor: Bernard Emile André Dussart, Denain, France

[73] Assignee: Union Siderurgique du Nord et de l'Est de la France, Paris, France

[21] Appl. No.: 748,301

[22] Filed: Dec. 7, 1976

Related U.S. Application Data

[63] Continuation of Ser. No. 593,959, Jul. 8, 1975, abandoned.

[30] Foreign Application Priority Data

Jul. 22, 1974 [FR] France ..... 74 25315

[51] Int. Cl.[2] ..... B22D 27/02

[52] U.S. Cl. ..... 164/49; 164/250

[58] Field of Search ..... 164/49, 250, 48

[56] References Cited

U.S. PATENT DOCUMENTS

| | | | |
|---|---|---|---|
| 2,963,758 | 12/1960 | Pestel et al. | 164/49 X |
| 3,811,490 | 5/1974 | Middleton et al. | 164/49 |
| 3,947,533 | 3/1976 | Davis | 164/49 X |
| 3,952,791 | 4/1976 | Ito et al. | 164/49 |
| 3,981,345 | 9/1976 | Alberny et al. | 164/49 |

FOREIGN PATENT DOCUMENTS

| | | | |
|---|---|---|---|
| 313,609 | 1/1970 | U.S.S.R. | 164/49 |

*Primary Examiner*—Richard B. Lazarus

*Attorney, Agent, or Firm*—Burns, Doane, Swecker & Mathis

[57] ABSTRACT

A process and installation for stirring metal in a continuous-casting mould by forming in the ingot mould an electromagnetic induction field rotating about an axis parallel to, or coinciding with, the axis of the ingot mould by means of a stator supplied with alternating inducting current. According to the invention, the liquid metal surrounded by a ring of solidified metal and the copper ingot mould is driven in rotation by employing a field produced by an inducing current of frequency lower than 10 Hz.

4 Claims, 3 Drawing Figures

PROCESS FOR ELECTROMAGNETIC STIRRING

This is a continuation of application Ser. No. 593,959, filed July 8, 1975, now abandoned.

The present invention relates to a process for stirring metal employed in installations of the continuous-casting type. It more particularly concerns such a stirring process by electromagnetic means and a device for carrying out said process.

It is known that in order to improve the metallurgical qualities of the metal, and in particular reduce the disadvantageous dendritic structure, there have been employed metal stirring processes employing centrifugation, this centrifugation being achieved, on an industrial scale, mechanically. However, this mechanical process has a number of drawbacks, mainly in that it cannot be employed with any type of continuous-casting nor with any type of product, since it implies the rotation of the ingot mould about a vertical axis. Thus, in particular, it cannot be employed in the case of a continuous-casting in a curved path. Moreover, the solidified steel participates in the rotation which is hardly advantageous as concerns the efficiency of the phenomena created at the interface between the liquid metal and the solid metal. Lastly, the presence of mechanical, relatively large devices and a rotating ingot mould pose very serious problems of location and bedding of the equipment.

This is why it has also be contemplated to achieve the stirring by electromagnetic centrifugation; the rotation of the liquid metal being obtained by means of a rotating field produced by an inducing alternating current. This process has given encouraging results as to the metallurgical quality of the metal obtained but it also has very serious drawbacks which have up till now retarded its utilisation on an industrial scale. Thus, the heating of the ingot mould under the effect of eddy currents generated therein very rapidly wears out this ingot mould and requires the use of ingot moulds of a metal having a resistivity higher than that of copper. Brass, aluminium, bronze or molybdenum ingot moulds have thus been employed, but as these metals have a lower heat conductivity than copper, their life is very short and this is a considerable drawback. Moreover, in the known electromagnetic centrifugation process the losses owing, on one hand, to the creation of eddy currents in the metal of the ingot moulds and, on the other, to the damping of the field in traversing the ingot mould, result in a particularly low energetic efficiency.

An object of the present invention is to improve the known process and device for stirring a metal in a continuous-casting installation by the application of a rotating induction field so as to permit the utilisation of a normal copper ingot mould and the obtainment of a substantially increased energetic efficiency.

This problem is solved in accordance with the invention by generating in the metal contained in the ingot mould a rotating induction field obtained by an inducing current of frequency lower than 10 Hz.

Preferably this frequency is between about 2 and 6 Hz.

Moreover, the intensity of the magnetic induction field produced is between 500 and 2000 Gauss and preferably between 1000 and 1500 Gauss.

As will be seen from the ensuing description, the fact of employing a particularly low-frequency for the inducing current permits a considerable reduction in the eddy currents generated in the metal of the ingot mould and an attenuation of the damping of the field passing through this ingot mould.

Another object of the invention is to provide a device for carrying out said process, comprising a triphase stator disposed concentrically with respect to the ingot mould, wherein the ingot mould is of copper and the triphase stator is supplied with a current alternating at a frequency lower than 10 Hz and preferably between 2 and 6 Hz.

The invention will be described in more detail hereinafter with reference to the accompanying drawing given merely by way of example and in which.

Figure 1:
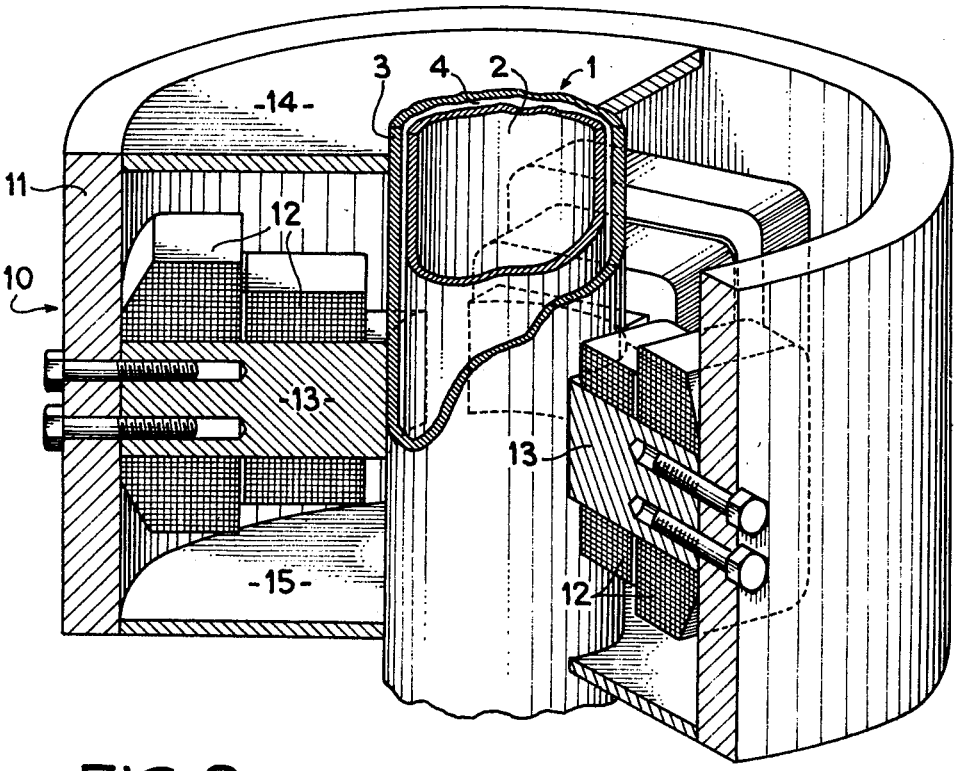
FIG. 1 is a partial diagrammatic view of a continuous-casting installation provided with a device according to the invention.

FIG. 1 shows a part of a conventional continuous-casting installation, only a part of the ingot mould of which has been shown. This ingot mould 1 comprises an inner part 2 of copper surrounded by a jacket defined by a case 3 of stainless steel through which jacket a cooling fluid 4, such as water, flows.

The pouring spout which supplies liquid metal to the ingot mould has not been shown in the drawing, nor has the secondary cooling zone located at the lower part of the ingot mould.

According to the invention, there is provided a triphase stator 10 comprising a frame 11, coils 12 and poles 13 evenly spaced apart on the periphery of the ingot mould.

This assembly is normally completed by a cover 14 and a bottom wall 15 of annular shape which cover and protect the stator.

Figure 2:
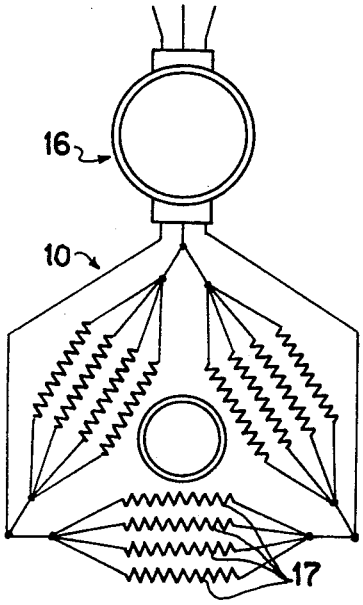
FIG. 2 is an electric diagram of this device.

FIG. 2 is a diagram of an electric circuit corresponding to the device shown in FIG. 1 and comprising mainly a triphase stator 10 whose three phases are delta-connected in the presently-described embodiment and supplied with current by a rotary converter set 16 which is in fact an alternator itself supplied with triphase alternating current at industrial frequency of 50 cycles. Preferably, each one of the phases of the stator is constituted by a plurality of coils 17 connected in parallel, namely four in the presently-described embodiment, each coil having for example 150 turns of wire of a section of 14 $mm^2$. The voltage at the input of the converter set may be 380 volts, this set furnishing an inducing current at the frequency of 6 Hz at a voltage of the order of 57 volts for an intensity per phase of 100 amps. The power of the converter set is thus of the order of 10 KVA. These characteristics permit the production of a rotating induction field of the order of 1000 to 1500 Gauss.

Tests carried out with such a stirring device show that the efficiency of the electromagnetic centrifugation obtained with a very low-frequency inducing current, and in particular a frequency markedly lower than 10 Hz, is substantially improved and has an important effect on the surface structure of the steel cast. This effect may be attributed, on one hand, to a skin effect which results from the displacement of the liquid metal with respect to the solidified metal which limits the basaltic zone, this relative displacement producing a kind of scraping which has for effect to unstick the inclusions and porosities or blow-holes contained in the metal. This substantially improves the compactness in the peripheral ring of the cast product. This skin effect is associated with a centripetal overall effect which separates from the skin of the product the aforementioned inclusions and porosities, whose density is much lower than that of the steel, and moves them toward the centre part of the metal.

The fact of employing the very low frequencies mentioned hereinbefore permits substantially increasing the intensity of the rotating field causing the rotation of the metal and thus permits increasing the two aforementioned effects. This is of particular importance in view of the fact that the blow-holes contained in the metal are also eliminated, which the prior process could not suggest and which moreover permits extending the field of application of such a process to the treatment of effervescent or semikilled steels.

This extension is also particularly novel with respect to the prior art.

As the rotating field exerts its driving effect on the entire cross section of the poured product, a favourable incidence of the pouring jet is unnecessary for causing the rotation of the metal. Thus it is possible to envisage the pouring with an immersed spout and to maintain a conventional protection of the liquid meniscus by a covering powder.

It is of interest to point out why the contemplated frequencies permit the obtainment of such a result with no need to repeat here the details of the calculations and formulae which demonstrate it.

It is known that the steel is driven in a movement of rotation under the effect of electromagnetic forces or Laplace forces which are proportional to the intensity of the current induced in the liquid steel and to the induction field acting on the considered conductor. These driving forces are proportional to the frequency $f$ of the inducing current.

Moreover, the alternating variation of the field in the copper of the ingot mould also induces eddy currents whose intensity is proportional to the frequency of the field, the energy dissipated by these eddy currents being proportional to the square of the frequency of the inducing currents. Numerical values taken from the following table indicate the value of the power dissipated by the eddy currents in the copper in the case of an ingot mould of a diameter of 120 mm and a thickness of 10 mm in respect of frequencies equal to 50, 6 and 3 Hz respectively. It can be seen that at a frequency of 50 Hz, the power dissipated is considerable and roughly corresponds to 40% of the extraction of heat achieved by the ingot mould in a continuous-casting line producing 15 metric tons per hour. On the other hand, at frequencies of 6 and 3 Hz this dissipated power is readily acceptable.

Another element of the phenomenon resides in the damping of the alternating induction field in the copper of the ingot mould. This alternating induction field is damped by the creation of reactive eddy currents according to an exponential law of the type:

$$B = B_o e\,(x/xo)$$

wherein:

*Bo* represents the value of the induction at the point of origin $$x_o = \sqrt{\rho/\pi\mu f}$$

with $\rho$ = resistivity of the metal $\mu$ = magnetic permeability $f$ = frequency of the induction field which therefore only depend on the electromagnetic characteristics of the material and the frequency of the induction current. The following table gives an indication of the value of $x_o$ and of the damping of the field, as a function of the frequency and of the different amagnetic media passed through, namely: the copper of the ingot mould, the stainless steel of the jacket, the liquid steel and, assuming that the ingot mould, disposd perpendicularly to the original induction field, has a thickness of 10 mm. It is clear from this table that as the thickness of the skin is inversely proportional to the square root of the frequency, the damping of the field is markedly greater for an industrial frequency of 50 Hz than for the two chosen frequencies of 6 and 3 Hz.

TABLE

| Power dissipated by the eddy currents in the copper of an ingot mould in Kw | | Frequency 50Hz 145 | 6Hz 9 | 3Hz 5 |
|---|---|---|---|---|
| Thickness of the skin $x_o$ in mm | Copper at 20° C | 9.35 | 27.0 | 38.1 |
| | Copper at 100° C | 10.70 | 31.0 | 43.6 |
| | Stainless steel at 0° C | 65.5 | 190 | 266.0 |
| | Liquid steel | 91.0 | 260 | 367 |
| Damping of the field $\frac{B}{Bo}$ across: | 10mm of copper at 0° C | 0.34 | 0.69 | 0.77 |
| | 10mm of copper at 100° C | 0.39 | 0.72 | 0.88 |
| | 10 mm of stainless steel | 0.86 | 0.95 | 0.97 |
| | 10 mm of liquid steel | 0.90 | 0.96 | 0.98 |

Figure 3:
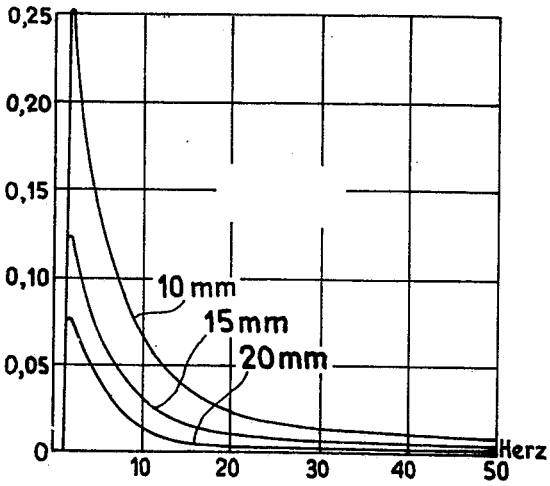
FIG. 3 is a diagram showing the variation in the energetic efficiency as a function of the frequency of the inducing current.

It results from the foregoing considerations that the energetic efficiency of the device, represented by a coefficient R equal to the ratio between the driving power and the power dissipated in the copper, varies as a function of the frequency in accordance with the diagram shown in FIG. 3 in which the three curves represent the variation in this ratio R in the case of thickness of the copper wall of the ingot mould equal to 10, 15 and 20 mm, respectively, assuming that the ingot mould has a diameter of 120mm and that the speed of rotation of the liquid steel is equal to about 1rps.

It can be seen from this graph that the zone of the frequency according to the invention permits operating in the part of the curve where this efficiency has optimum value, whereas the industrial frequencies conventionally employed give only an extremely low energetic efficiency.

In other words, it may be stated that, irrespective of the section of the products cast, whether these products be round or in the form of billets, and of the nature of the movement induced, a sliding or rotating stirring, the energetic efficiency of the stirring is maximum for a frequency of the inducing current which is roughly between the frequency of synchronism and double this frequency, the frequency of synchronism being defined as being the frequency at which the steel is driven at the same rotational speed as the rotating field.

The process according to the invention provides the following advantages:

It permits obtaining products having a quite exceptional purity of skin, which avoids cleaning before the subsequent rolling;

It permits eliminating not only the inclusions in the peripheral zone of the cast product, but also the porosities and the lenticular blow-holes; this permits contemplating the application of the process to the treatment of effervescent and semikilled steels.

The compactness of the basaltic structure is substantially improved and this permits avoiding casting cracks in respect of steels having a fragile skin without limiting the extracting speeds.

It permits the utilisation of a copper ingot mould having a normal wall thickness, namely of the order of 10, 15 or 20 mm, as opposed to that required by the conventional electromagnetic centrifugation process.

It must be understood that the invention is not intended to be limited to the manner of carrying out the invention described and illustrated. Thus it may be applied to the case of a centrifugation of a billet or the like which does not have a circular section, the lines of the motion of the steel under the effect of the rotating field being then substantially different from those obtained in the case of a round product. The results obtained are nonetheless comparable.

The same is true as concerns the construction and position of the stirring device with respect to the ingot mould. As concerns the electric circuit, it may be substantially different and employ for example a star circuit or a static converter having thyristors instead of a rotating converter unit. Moreover, the stator may be disposed at least in part in the cooling jacket instead of outside the latter.

I claim:

1. A continuous-casting process for liquid metal comprising the steps of:

pouring liquid metal into a stationary continuous-casting mold having a copper wall of about 10 to 20mm thickness;

producing a rotating electromagnetic induction field in the mold and in the metal having an intensity between 500 and 2000 Gauss and exciting the electromagnetic induction field with an alternating current having a frequency less than 10 Hz thereby minimizing eddy currents in the mold and attenuating field damping;

rotating the electromagnetic induction field about an axis substantially parallel to a longitudinal axis of the mold to rotate liquid metal relative to the solidified peripheral portion at a frequency between a synchronism frequency, defined as the frequency at which the induction field and the liquid metal have the same rotational speed, and twice the synchronism frequency;

thereby scraping inclusions and porosities from the solidified peripheral portion by relative movement between the liquid metal and the solidified peripheral portion and moving the inclusions and porosities toward the center of the liquid metal by the effect of the centrifugal force exerted on the metal which is much more dense than the inclusion and porosities so that an improved surface structure results.

2. A process as claimed in claim 1, wherein said frequency is between substantially 2 and 6 Hz.

3. A process as claimed in claim 1, wherein the induction field intensity is between substantially 1000 and 1500 Gauss.

4. The process of claim 1 wherein the liquid metal is rotated with a frequency in the range of 1 to 2 rps.

* * * * *